United States Patent [19]

Fram

[11] 4,253,363

[45] Mar. 3, 1981

[54] ROVING CUTTER WITH POSITIVE EJECTION CUTTING HEAD

[76] Inventor: Jerry R. Fram, 10627 Rochester Ave., Los Angeles, Calif. 90024

[21] Appl. No.: 33,156

[22] Filed: Apr. 25, 1979

[51] Int. Cl.[3] ..... D01G 1/04

[52] U.S. Cl. ..... 83/114; 83/116; 83/346; 83/913

[58] Field of Search ..... 83/116, 114, 115, 117, 83/913, 346, 347

[56] References Cited

U.S. PATENT DOCUMENTS 3,555,947 1/1971 Fram ..... 83/116

*Primary Examiner*—J. M. Meister

*Attorney, Agent, or Firm*—Keil & Witherspoon

[57] ABSTRACT

A roving cutter with a positive ejection cutting head in which the ejection elements provided in the spaces between the circumferentially spaced cutting blades are mounted in eccentrically rotating end places under axial tension so as to form with the end plates a squirrel cage-like rigid assembly. By placing the ejection elements under lengthwise tension they can be given the required rigidity in spite of being reduced in cross section, for example to take on the form of rods or wires. Because of this, longer cutters become possible and in cutters of conventional length greater clearances can be obtained and thus the build-up of fiber material or dust in the spaces between the blades more effectively avoided.

9 Claims, 3 Drawing Figures

ROVING CUTTER WITH POSITIVE EJECTION CUTTING HEAD

BACKGROUND OF THE INVENTION AND PRIOR ART

The invention relates to roving cutters with a positive ejection cutting head and, more particularly, to improvements of the roving cutter of this type disclosed in my U.S. Pat. No. 3,555,947, issued Jan. 19, 1971.

In my U.S. Pat. No. 3,555,947—the specification and drawings of which should be considered incorporated herein for purposes of disclosure—there is shown a roving cutter, the cutting head of which is provided with positive ejection means by which, on every revolution of the cutting head, the cut fibers are automatically pushed out of the spaces between the blades.

More specifically, the cutting head of the roving cutter according to my earlier patent has a cutter wheel with a set of circumferentially spaced blades which project radially outwardly from this wheel; the cutter further has, adjacent to one side of the wheel, a driven anvil member, covered with a sheath of resiliently yieldable material, such that the cuttter wheel and the anvil member define between them a roving cutting nip; and the cutting head also has a set of circumferentially spaced ejection elements which are mounted for movement in the spaces between the cutting blades, in an orbit which has an axis eccentric to that of the cutter wheel. As a consequence, the cut rovings are positively ejected from these spaces on every revolution of the cutting head as the latter, in operation, is rotated through the engagement of the cutting blades with the sheath covering the driven anvil member.

The ejection elements are in the form of ejector bars which move in the aforementioned eccentric orbit and which are guided by spacer bars which confine the in-and-out movement of each ejection bar to a linear radial path symmetrically extending between the adjacent pair of cutter blades. The ejection bars are suspended in rings so as to facilitate the incremental circumferential movement relative to the blades which results from the aforementioned linear radial guidance afforded by the spacer bars.

OBJECT AND SUMMARY OF THE INVENTION

While the positive ejection cutter disclosed in my earlier patent has been in most respects highly satisfactory, the implementation shown therein is subject to certain limitations as far as the feasible length of the cutter and the cross-section required for the ejection elements, and hence the obtainable clearances, are concerned. It is the principal object of the present invention to provide means by which these limitations can be avoided and thus the range of application of the cutter considerably extended.

Briefly, according to the present invention this object is met by providing for the set of ejector elements to be carried by a pair of end members which are mounted adjacent the two ends of the cutter wheel, respectively, for rotation about the above-mentioned eccentric axis, under axial tension. Preferably, these end members are in the form of a pair of mounting plates which form with the circumferentially spaced ejection elements an eccentrically rotating squirrel cage-like rigid structure. As will become clear from the detailed description given hereinbelow, this means that the ejection elements which, relatively to the respective pair of cutter blades, were in my earlier patent, forced into a linear radial path, are, in the case of my present invention, permitted to execute a small circular movement in the space between the two adjacent blades as they orbit about the aforementioned eccentric axis.

By virtue of the mounting of the ejection elements under tension according to my present invention, it becomes possible to make longer positive-ejection cutters than was heretofore possible, for the reason that the ejection elements, now being under tension, can be kept rigid in spite of a small cross-section. For example, a cutter as much as 46 inches long becomes feasible for cutting stiff impregnated graphite fibers into ½ inch lengths.

By the same token, ejection elements on existing cutter sizes can be made with smaller cross-sections like spokes or tightly stretched wires, and this makes greater clearances possible. Based on this principle ⅛ inch positive ejection cutters for cutting wet glass can be built. The greater clearances considerably reduce the difficulties heretofore experienced with build-up of damp glass dust. This is in contrast to the existing design of positive ejection cutting heads where the ejection bars due to their small clearances can become clogged fairly quickly with glass dust.

BRIEF DESCRIPTION OF THE DRAWINGS

A preferred embodiment of my invention will now be described with reference to the accompanying drawings in which.

DETAILED DESCRIPTION

Figure 1:
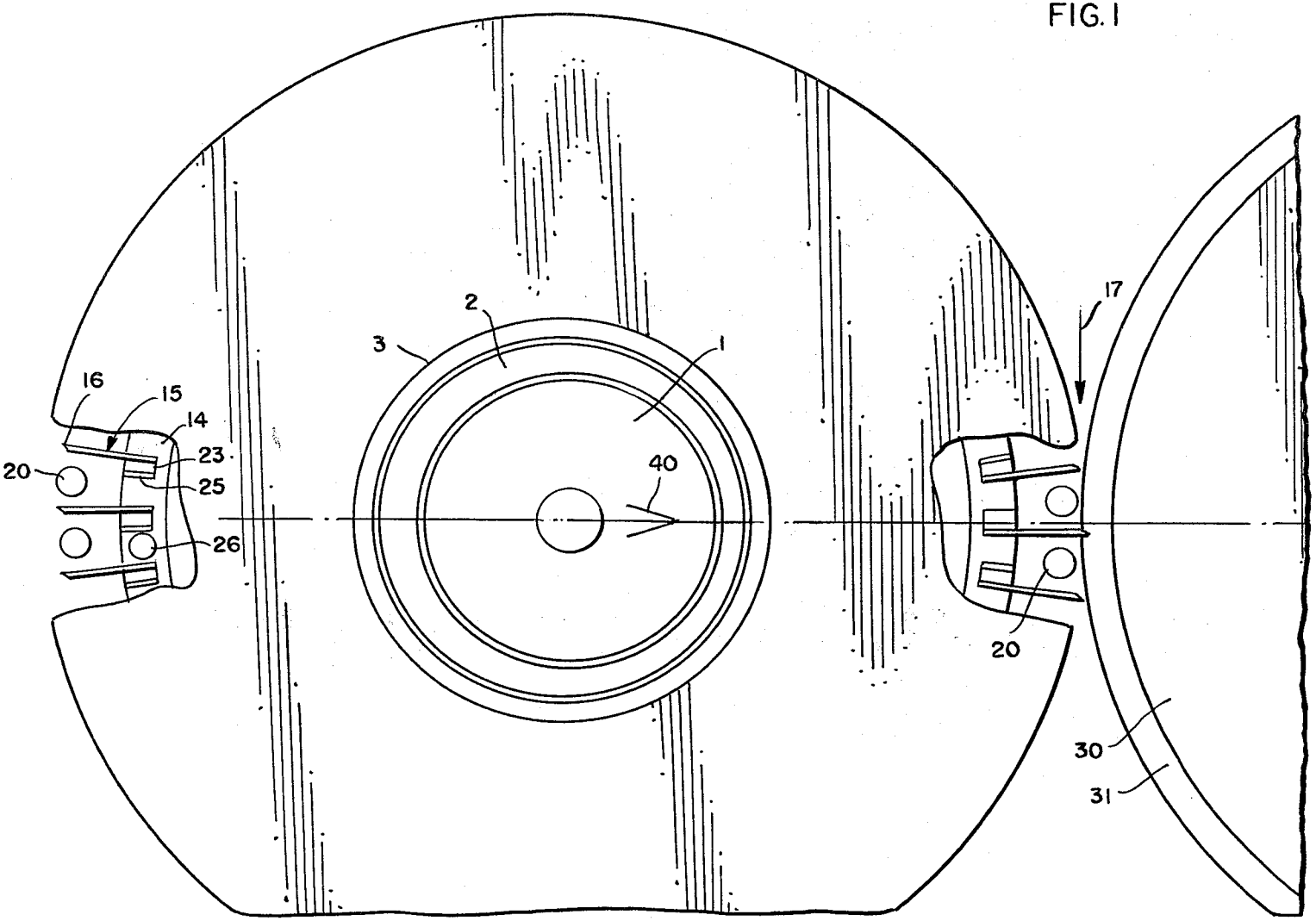
FIG. 1 is an end view of the cutter according to the invention, including the cutter head and part of the anvil roll cooperating therewith.
Figure 2:
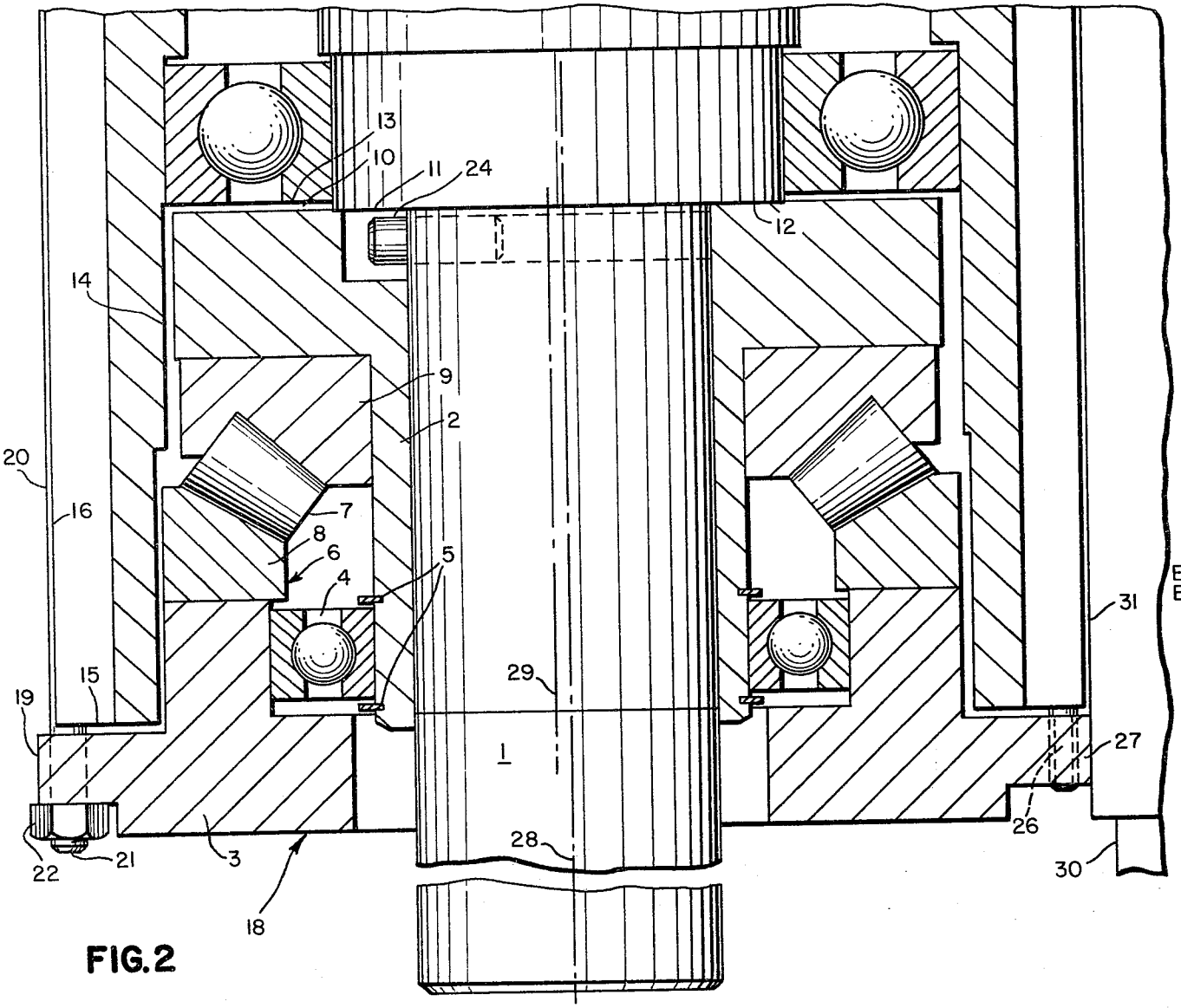
FIG. 2 is a top plan view, partly in section, of the left end, as viewed in FIG. 2, of the cutter shown in FIG. 1; the right-hand end, not shown of the cutter assembly, is substantially the mirror image of the left end illustrated in FIG. 2.

Referring now to FIGS. 1 and 2, 1 is the stationary shaft of the cutter, on which there is formed a collar 12. Rotatably mounted on this collar by means of an anti-friction, for example ball bearing 13, is the cutter wheel 14 of the cutter. The cutter wheel and the positive ejection mechanism described in detail hereinbelow form the principal parts of cutter head 18. It will be understood that at the other end of shaft 1, not shown in FIG. 2, another collar is formed which also rotatably supports cutter wheel 14 with another such anti-friction bearing. Cutter wheel 14 which is substantially in the form of a hollow cylinder, carries, projecting from its outer periphery, a set of circumferentially spaced cutter blades 16 which project radially from the cylindric outer surface of the cutter wheel. These blades may be mounted in the cutter wheel in any suitable way, for example by means of spacers 23 and wavy springs 25, FIG. 1. These mounting means as well as the blades 15 themselves extend over the full length of cutter wheel 14.

As indicated in FIGS. 1 and 2, the cutting blades 15 engage with their cutting edges 16 a covering or sheath 31 of resiliently yieldable material which is mounted on anvil roll 30. This anvil roll is driven by a motor not shown and, due to the engagement of the resilient covering 31 by the blades 15, the cutting wheel 14 will, in turn, be rotated by the anvil roll in the manner well known in the art.

In operation, shaft 1 and cutting head 18 mounted thereon are at all times urged toward the anvil roll, for instance by hydraulic or resilient means, as schematically indicated by arrow 40, FIG. 1. In the operation of the cutter, filamentary material, for example in the form of glass roving is fed in the direction of arrow 17 into the nip between the cutter blades 15 and anvil roll covering 31, to be cut in this nip, the length of the cut rovings corresponding substantially to the spacings between the cutting edges 16. In the process the resilient covering 31 is slightly deformed due to the engagement of the cutting edges 16 therewith. In order to let the design of the cutter assembly stand out more clearly, the roving, before as well as after cutting, has not been shown in FIGS. 1 and 2, but reference in this connection is made to my earlier U.S. Pat. No. 3,555,947.

The positive ejection mechanism according to the invention, which serves to physically eject any cut rovings or fibers from the space between the blades on each revolution of the cutting head, will now be described. This ejection mechanism comprises two end plates 19, one at each end of the cutting head, on which a set of circumferentially spaced ejection elements—in the embodiment shown in the form of rods 20—are mounted under tension. As will be seen from FIG. 1, these rods 20 are mounted on end plates 19 so as to extend, throughout the length of the cutting head, in the spaces between cutting blades 15. The ends 21 of ejection rods 20 are passed with clerance through circumferentially spaced apertures in the peripheral portion of end plates 19. Ends 21 of rods 20 are threaded and these threads are engaged by nuts 22 which, when tightened against the outer faces of the respective end plates 19, place ejection rods 20 under longitudinal tension.

The two end plates 19—of which only the left one is shown, with its associated parts in FIG. 2—are mounted for rotation by means of anti-friction bearings, for example ball bearings 4 about the outer surface of sleeves 2, one at each end, which are fixedly mounted on non-rotatable shaft 1 by a means of keys 24. As will be seen from FIG. 2, the outer cylindrical surface of sleeves 2 to which the inner races of ball bearings 4 are secured, is eccentric with respect to the axis 28 of non-rotatable shaft 1 which latter axis as will be understood from the above description, is also the axis of rotation of cutter wheel 14. The eccentric axis of sleeves 2, and hence of end plates 19, is shown at 29 in FIG. 2. The inner races of ball bearings 4 are located axially by means of spring rings 5. Rotation is imparted to end plates 3 by means of pins 26, FIGS. 1 and 2 in cutter wheel 14 which engage larger apertures 27 in end plates 19, that is the eccentrically mounted end plates are rotationally taken along by the cutter wheel.

Means are provided for taking up the axial pressure—acting to the right in FIG. 2 in the case of the left hand end plates shown there—which is exerted on end plates 19 when ejection rods 20 are placed under tension by the tightening of nuts 22. These means are in the form of anti-friction thrust bearings 6, one at each end, and each comprising an outer race 8, a set of frustoconical rollers 7 mounted at a slant, and an inner race 9. As will be seen from FIG. 2, end plates 19 bear axially on outer race 8 of the respective thrust bearing and the inner race 9 bears axially against a flange 10 formed on the respective sleeve 2. In this manner the axial forces exerted by end plates 19 are eventually taken up by non-rotatable shaft 1.

Figure 3:
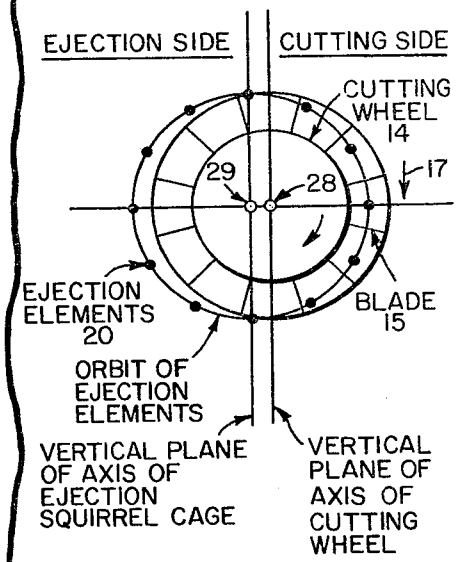
FIG. 3 is a schematic representation, in end view, of the cutting wheel carrying the cutting blades, and of the squirrel cage structure carrying the ejection elements and eccentrically mounted with respect to the cutting wheel; the figure serves to illustrate the movement of the ejection elements relatively to the blades.

From the foregoing description it will be clear that end plates 19 together with the ejection clements 20 mounted under tension therebetween, form a squirrel cage-like rigid structure which is mounted for rotation about eccentric axis 29. The ejection function of this mechanism will be better understood by an inspection of FIG. 3 in which the cutter wheel with the cutting blades 15 mounted thereon, and the ejection squirrel cage with its ejection elements 20, have been schematically shown in end view, as rotating about shaft axis 28 and eccentric axis 29, respectively. More particularly, FIG. 3 shows that axis 29 is eccentrically offset from axis 28 in a direction away from the cutting nip. The right side as viewed in FIG. 3 is the cutting side—or cutting nip side—and the left side has been denoted as the ejection side. It should be understood, however, that the ejection of cut fibers which may be present in the spaces between adjacent blades, begins immediately after the blades have cut the roving at nip 17.

More specifically, this ejection action is due to the ejection rods, on each revolution of the cutter head, moving outwardly in the spaces between the blades as long as these rods are in the lower half circle of their eccentric cylindrical orbit. Actually, as will be noted from FIG. 3, in rotating about eccentric axis 29, each ejection element 20 executes a small circular motion in relation to the adjacent pair of blades 15.

Referring, for example, to the rod 20 shown in its right-most position in FIG. 3, that is in its position closest to the nip, it will be observed that this rod is at its radially innermost point where it is recessed from the cutting edges of the blades and hence does not interfere with the cutting action, and that it is midway between the two adjacent blades. In moving past the nip the rod is shifted not only outwardly but also in the direction towards the leading one of the two blades throughout the first 90° of its clockwise orbit. During the second 90° of its orbit the outward shift of the rod continues but at the same time the rod moves in the direction of its symmetrical position between the two blades, this position being reached at the end of a half revolution. Throughout the third and fourth quarters of the revolution, the rod moves radially inwardly but at the end of the third quarter it has assumed a position relatively closer to the trailing one of the two blades, and it returns to its original midway position between the two blades upon completion of a full revolution.

In short, with respect to two adjacent blades the rod is subject to a small circular shifting motion within the space between the two blades. This circular shifting motion results from the fact that, in the case of the present invention, the ejection elements are rigidly mounted on the eccentrically rotating end plates 19 whereas in the case of my U.S. Pat. No. 3,555,947 the ejection bars are constrained by spacer bars to a straight radial—outward and inward—relative shift at a location symmetrical to the two adjacent cutting blades. Any possible complications due to this linear guiding mechanism thus is obviated in the case of the instant invention.

More importantly, since the ejection elements according to the present invention are placed under lengthwise tension, they can be given the required rigidity in spite of a reduction in cross section. Because of this, longer cutters become possible and in cutters of conventional length greater clearances can be obtained. This in turn reduces the build-up of cut fiber material or dust and it enhances the quality of the cutting operation and hence of its product.

It will be understood that the above embodiment of the invention is shown herein by way of example only and that it should not be construed in a limiting sense.

What is claimed is:

1. In a roving cutter of the type comprising a cutting head having a cutter wheel with a set of circumferentially spaced blades projecting radially outwardly from said wheel, and an anvil member contiguous to one side of said wheel, said cutter wheel and said anvil member defining a roving cutting nip, and said cutting head also having a set of circumferentially spaced ejection elements mounted for movement, in the spaces between said blades, in an orbit having an axis eccentric to the axis of said cutter wheel so as to positively eject the cut rovings from said spaces, the improvement that the ejection elements are fixedly carried, under longitudinal tension by a pair of end members mounted adjacent the two ends of said cutter wheel, respectively.

2. In a roving cutter the improvement as claimed in claim 1, wherein said end members are in the form of mounting plates forming with said circumferentially spaced ejection elements an eccentrically rotating squirrel cage-like rigid structure.

3. In a roving cutter the improvement as claimed in claim 1, wherein said ejection elements have end portions extending through apertures in said end members and wherein there are provided tightening members engaging said end members for drawing said ejection elements towards the respective end members, thereby to produce said longitudinal tension.

4. In a roving cutter the improvement as claimed in claim 3, wherein said ejection elements are of round cross-section; wherein said end portions are threaded; and wherein said tightening members are in the form of nuts bearing on the outside of the respective end members.

5. In a roving cutter the improvement as claimed in claim 2, wherein said cutting head includes two thrust bearings each interposed between the corresponding mounting plate and a corresponding relatively-stationary element on said cutting head.

6. In a roving cutter the improvement as claimed in claim 2, wherein said cutting head includes a non-rotatable shaft and two sleeve members each secured to said shaft adjacent the corresponding end of said head, each said sleeve member having an outer cylindrical surface with an axis eccentric to the axis of said shaft and each said mounting plate being mounted for rotation about the eccentric surface of the respective sleeve member.

7. In a roving cutter the improvement as claimed in claim 6, wherein an anti-friction bearing is interposed between each said mounting plate and the eccentric surface of the respective sleeve member.

8. In a roving cutter the improvement as claimed in claim 6, wherein each said sleeve member has a flange portion, and wherein an anti-friction thrust bearing is interposed between the corresponding mounting plate and the corresponding flange portion to take up the axial forces exerted by said mounting plates due to the tensioning of said ejection elements.

9. In a roving cutter the improvement as claimed in claim 6, wherein anti-friction bearing means are provided for rotatably mounting said cutter wheel on a collar of said non-rotatable shaft.

* * * * *